US008448658B2

(12) United States Patent
Jin et al.

(10) Patent No.: US 8,448,658 B2
(45) Date of Patent: May 28, 2013

(54) RESCUE DEVICE FOR LEAKAGE OF DANGEROUS CHEMICALS

(75) Inventors: Yuechun Jin, Beijing (CN); Junbo Zhang, Beijing (CN); Chuan Jin, Beijing (CN)

(73) Assignee: Beijing Tianqing Chemicals Co, Ltd., Beijing (CN)

( * ) Notice: Subject to any disclaimer, the term of this patent is extended or adjusted under 35 U.S.C. 154(b) by 174 days.

(21) Appl. No.: 13/002,864

(22) PCT Filed: Jul. 6, 2009

(86) PCT No.: PCT/CN2009/072637

§ 371 (c)(1), (2), (4) Date: Mar. 23, 2011

(87) PCT Pub. No.: WO2010/003355

PCT Pub. Date: Jan. 14, 2010

(65) Prior Publication Data

US 2011/0297242 A1 Dec. 8, 2011

(30) Foreign Application Priority Data

Jul. 7, 2008 (CN) ..... 2008 1 0130541

(51) Int. Cl.
*F15D 1/00* (2006.01)
*B65D 21/00* (2006.01)

(52) U.S. Cl.
USPC ..... 137/15.11; 137/312; 137/264; 220/23.83

(58) Field of Classification Search
USPC ..... 137/15.11, 312, 264; 220/23.83, 220/23.87; 222/108
See application file for complete search history.

(56) References Cited

U.S. PATENT DOCUMENTS

| | | | | |
|---|---|---|---|---|
| 4,350,018 | A | 9/1982 | Frank et al. | |
| 4,587,992 | A * | 5/1986 | Thompson | 137/264 |
| 5,971,009 | A * | 10/1999 | Schuetz et al. | 137/312 |
| 6,003,540 | A * | 12/1999 | Bruni et al. | 137/312 |
| 7,357,144 | B2 * | 4/2008 | Im et al. | 137/15.04 |

FOREIGN PATENT DOCUMENTS

| | | |
|---|---|---|
| CN | 1113538 | 12/1995 |
| CN | 1 675 110 | 9/2005 |
| CN | 101 032 641 | 9/2007 |
| CN | 101 067 472 | 11/2007 |
| JP | 60-116193 | 8/1985 |
| JP | 3-34572 | 4/1991 |
| JP | 6-117733 | 4/1994 |
| JP | 1 11 650 57 | 6/1999 |
| JP | 2003-190704 | 8/2003 |
| JP | 2005-297994 | 10/2005 |
| WO | 95/27668 | 10/1995 |

* cited by examiner

*Primary Examiner* — Kevin Lee
(74) *Attorney, Agent, or Firm* — Fay Kaplun & Marcin, LLP

(57) ABSTRACT

A rescue device for treating leakage of dangerous chemical includes a first container having a closed negative pressure chamber and an intake which allows outside dangerous chemicals to enter the first container and a second container installed and fixed in the first container. The second container contains a substantially harmless liquefied gas and has an opening which controllably communicates with the external environment. When the dangerous chemicals are leaking, the rescue device can be used to reduce the loss of dangerous chemical, alleviate the harm to the environment and human, and avoid the possible disastrous consequences.

20 Claims, 1 Drawing Sheet

RESCUE DEVICE FOR LEAKAGE OF DANGEROUS CHEMICALS

TECHNICAL FIELD

The present invention relates to treatment for dangerous chemicals, in particular, to a rescue device and method for treating the leakage of dangerous chemicals.

BACKGROUND OF ART

Chemicals are indispensable to the industrial production and the people's life. Moreover, most of chemicals are dangerous chemicals, in which most of them are fluids including gasses and liquids. During the production, storage, transportation and use of dangerous chemicals, leakage problems sometimes occur due to the aging of a container, high temperature and accidents, which will lead to the harm to the environment and even result in disastrous consequences. Prompt and effective rescue is important to reduce the harm and avoid the disastrous consequences.

SUMMARY OF INVENTION

The present invention relates to a novel rescue method for leakage of dangerous chemicals. Specifically, when the dangerous chemicals leak, using an automatic cooling device with negative pressure, the dangerous chemicals which are not leaking can be safely, quickly and effectively introduced into the device, so as to reduce the harm to the human and environment and avoid the possible disastrous consequences.

In one aspect, the present invention relates to a rescue device for treating leakage of dangerous chemicals. The rescue device comprises:

a first container having a closed negative pressure chamber and an intake which allows outside dangerous chemicals to enter the first container; and a second container installed and fixed in the first container, the second container contains a substantially harmless liquefied gas and has an opening which controllably communicates with the external environment.

When the dangerous chemicals leak due to accidents or the aging of a device, or the stocked dangerous chemicals are threatened by high temperature, the rescue device of the present invention can be used. First of all, the first container is connected with a leaking container through an intake on the first container. Under the negative pressure, the dangerous chemicals which are not leaking in the leaking container can flow into the first container. Moreover, the opening of the second container can be opened at an appropriate moment so that the temperature in the first container decreases by releasing the liquefied gas in the second container, and thereby the pressure in the first container reduces, so as to absorb more dangerous chemicals from the leaking container, reduce the loss of the dangerous chemicals, alleviate the harm to the environment and human, and avoid the possible disastrous consequences.

Therefore, in another aspect, the present invention relates to a rescue method for treating leakage of dangerous chemicals comprising:

(1) providing a rescue device, which comprises:

a first container having a closed negative pressure chamber and an intake which allows outside dangerous chemicals to enter the first container; and a second container installed and fixed in the first container, the second container contains a substantially harmless liquefied gas and has an opening which controllably communicates with the external environment;

(2) connecting the intake which allows the outside dangerous chemicals to enter the first container with a container in which the dangerous chemicals are leaking, so as to introduce the dangerous chemicals which are not leaking into the rescue device; and (3) opening the opening of the second container and releasing the substantially harmless liquefied gas in the second container so that the temperature and pressure in the first container reduce so as to introduce more dangerous chemicals which are not leaking into the rescue device.

The rescue device of the present invention can be a separate container, or a container loaded by vehicles.

The rescue device of the present invention can be used during rescue when flammable, explosive, toxic, corrosive, radioactive or chemical polluted dangerous chemicals, in particular more dangerous gases or liquids with low boiling points are leaking. The dangerous chemicals include but are not limited to phosphorus oxychloride, gasoline, bromine, liquid ammonia, liquid chlorine, liquid hydrogen sulfide, hydrocyanic acid, methyl isocyanate, ethylene oxide, natural gas, liquefied petroleum gas, alcohol, chloroform, and the like.

In one embodiment, the intake which allows the outside dangerous chemicals to enter the first container is made of a pressure-resistant and corrosion-resistant material and is arranged to seal connect or substantially seal connect with a container in which dangerous chemicals are leaking. The seal connection or substantially seal connection can be achieved with the methods well-known to one skilled in the art such as pipe connection, magnetic adsorption, and the like.

A second container is installed in the first container. The second container contains a substantially harmless liquefied gas. When the rescue is carried out while absorbing the dangerous chemicals which are not leaking, the substantially harmless liquefied gas can be released in the form of gas from the second container via opening a vent valve on the second container. The release of the liquefied gas absorbs the heat of the surrounding environment (i.e. the first container) so that the temperature of the container decreases and thereby the pressure in the first container reduces so as to absorb more dangerous chemicals from the leaking container.

The second container can be fixed in the first container with the methods well-known to one skilled in the art. Preferably, the second container is close to the intake of the first container which allows the outside dangerous chemicals to enter the first container, so as to make the temperature of the dangerous chemicals decrease rapidly. Furthermore, the second container does not directly contact with the first container so that the second container exchanges the heat quickly with the introduced dangerous chemicals in the first container, but does not exchanges the heat with the external environment through the walls of the first container.

The liquefied gas in the second container can be selected from a gas, of which the critical temperature is above the normal temperature and which is substantially harmless to the environment and human. The liquefied gas is a gas under the air pressure at the ambient temperature, but is a liquid under pressure at the ambient temperature. When the rescue device is not used, the second container is under pressure and the gas is maintained as a liquid. However, during the usage, the second container communicates with the outside and the liquefied gas is gasified and absorbs the environmental heat. Preferably, the liquefied gas is liquid carbon dioxide, which is readily available and inexpensive.

The first container and the second container are rigid and pressure-resistant containers, preferably steel tank or cylinder. The second container can be pressure-resistant in any shape such as cylindrical, spherical, snakelike tubular, and the like.

The second container of the present invention has an opening which controllably communicates with the external environment. The second container has one or more openings. In one embodiment, the opening is a manual vent valve. In another embodiment, the opening is an automatic vent valve. In another embodiment, the second container has not only a manual vent valve but an automatic vent valve.

In another embodiment, the first container has a pressure sensor. During the rescue, the pressure in the first container increases gradually to the equilibrium pressure. In this process, the change rate of the pressure is gradually getting slow. When the pressure sensor detects that the change rate of the pressure in the first container is lower than a predetermined value, a signal is delivered to a control system. The control system controls to open the automatic vent valve automatically.

When the liquefied gas of the present invention is selected to be liquid carbon dioxide, a person skilled in the art knows how to arrange the openings of the second container so as to prevent dry ice formed during the gasification of the liquid carbon dioxide from blocking the openings.

The device of the present invention can be used as an emergency rescue device for places and vehicles where liquid dangerous chemicals products are produced, stocked and used. The device of the present invention also can be used as a standing rescue device for a professional rescuer in the field of dangerous chemicals. The device of the present invention can reduce the security risks for producing, stocking, transporting and using dangerous chemicals, especially more dangerous gasses and liquids with low boiling points.

MODE OF CARRYING OUT INVENTION

The technical contents of the present invention are further illustrated by the following preferred embodiments of the present invention with reference to the drawings. It should be understood that the contents as shown in drawings are merely used to illustrate the present invention rather than limiting the scope of the present invention.

In each figure, the same component has the same number. For example, the number of the first container is 101 in FIG. 1, the number of the first container is 201 in FIG. 2, and so on.

Figure 1:
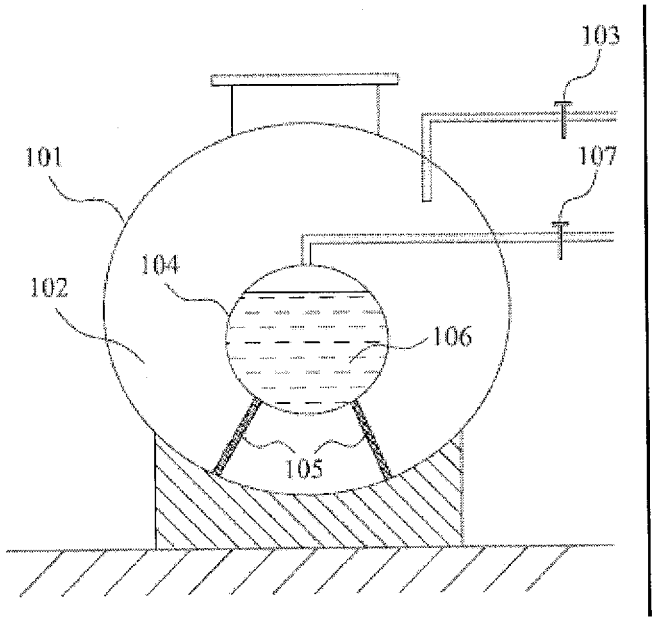
FIG. 1 is a schematic diagram of an embodiment of the present invention.

FIG. 1 is a schematic diagram of an embodiment in the present invention. A rescue device for leakage of dangerous chemicals comprises a first container 101 and a second container 104 fixed in the first container 101 via supports 105.

A closed negative pressure chamber 102 is formed in the interior of the first container 101. The first container 101 has an intake 103, which allows the outside dangerous chemicals to enter the first container 101. During the rescue, the first container 101 communicates with a leaking container through the intake 103. Under the negative pressure, the dangerous chemicals which are not leaking from the leaking container flow into the chamber 102 of the first container 101.

The second container 104 can be cylindrical or spheral. The second container 104 contains a liquefied gas 106. A liquid-level sensor (not shown) can be installed in the second container 104 to detect the amount of the liquid in the second container 104 at any time and to complement the liquid where needed.

The second container 104 has a vent valve 107, which controllably communicates with the external environment. The second container 104 may have one or more vent valves 107.

The liquefied gas 106 can be injected or complemented into the second container 104 through the vent valve 107 or other feed inlets (not shown).

During the rescue, when a certain amount of the dangerous chemicals flow into the first container 101 so that the pressure in the first container 101 is close to the equilibrium pressure, the vent valve 107 is opened to release the liquefied gas 106 in the second container 104. During the release, the liquefied gas 106 absorbs the heat of the surrounding environment (i.e. the first container 101) so that the temperature of the container decreases and thereby the pressure in the first container 101 reduces so as to absorb more dangerous chemicals from the leaking container.

Figure 2:
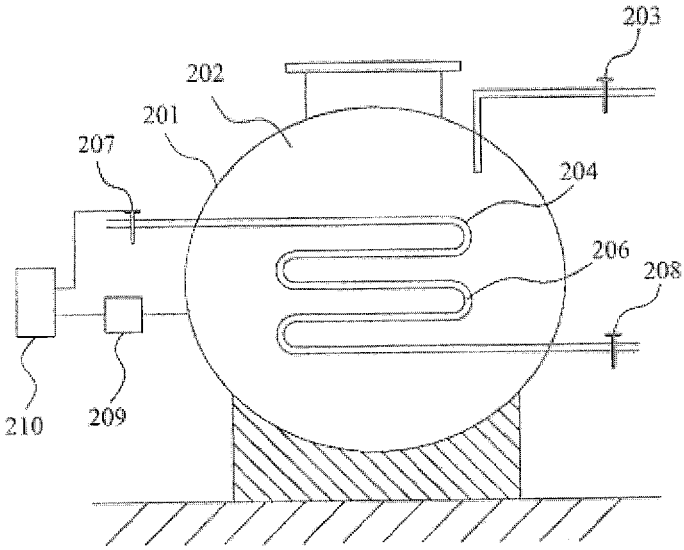
FIG. 2 is a schematic diagram of another embodiment of the present invention.

FIG. 2 is a schematic diagram of another embodiment of the present invention. A rescue device for leakage of dangerous chemicals comprises a first container 201 and a snakelike tubular second container 204 fixed in the first container 201.

A closed negative pressure chamber 202 is formed in the interior of the first container 201. The first container 201 has an intake 203 which allows the outside dangerous chemical to enter the first container 201. During the rescue, the first container 201 communicates with a leaking container through the intake 203. Under the negative pressure, the dangerous chemicals which are not leaking from the leaky container flow into the chamber 202 of the first container 201.

The second container 204 contains a liquefied gas 206.

The second container 204 has a vent valve 207, which controllably communicates with the external environment and has a feed inlet 208, through which the liquefied gas 206 are injected. The second container 204 may have one or more vent valves 207 and one or more feed inlets 208.

The first container 201 has a pressure sensor 209. During the rescue, when a certain amount of the dangerous chemicals flow into the first container 201 so that the pressure sensor 209 detects that the change rate of the pressure in the first container is lower than a predetermined value, a signal is delivered to a control system 210. The control system 210 controls to open or partly open the vent valve 207 so as to release the liquefied gas 206 in the second container 204. During the release, the liquefied gas 206 absorbs the heat of the surrounding environment (i.e. the first container 201) so that the temperature of the container decreases and thereby the pressure in the first container 201 reduces so as to absorb more dangerous chemicals from the leaking container.

The invention claimed is:

1. A rescue device for treating leakage of dangerous chemicals comprising:

a first container having a negative pressure chamber, the first container configured to be placed in an open position and a closed position, the open position allowing outside dangerous chemicals to enter the first container, the closed position preventing outside dangerous chemicals to enter the first container; and a second container installed and fixed in the first container; the second container contains a substantially harmless liquefied gas and has an opening which controllably communicates with the external environment.

2. A rescue device of claim 1, wherein the intake which allows the outside dangerous chemicals to enter the first container is made of a pressure-resistant and corrosion-resistant material and is arranged to seal connect or substantially seal connect with a container in which dangerous chemicals are leaking.

3. A rescue device of claim 1, wherein the first container and the second container are rigid and pressure-resistant containers.

4. A rescue device of claim 1, wherein the second container can be cylindrical, spherical or snakelike tubular.

5. A rescue device claim 1, wherein the second container is close to the intake of the first container which allows the outside dangerous chemicals to enter the first container, and the second container does not directly contact with the first container.

6. A rescue device of claim 1, wherein the substantially harmless liquefied gas is liquid carbon dioxide.

7. A rescue device of claim 1, wherein the opening is a manual vent valve.

8. A rescue device of claim 1, wherein the opening is an automatic vent valve.

9. A rescue device of claim 8, wherein the first container has a pressure sensor, where the pressure sensor detects that the change rate of the pressure in the first container is lower than a predetermined value, the automatic vent valve is controlled to open automatically.

10. A rescue device of claim 2, wherein the first container and the second container are rigid and pressure-resistant containers.

11. A rescue device of claim 2, wherein the second container is one of cylindrical, spherical and snakelike tubular.

12. A rescue device of claim 3, wherein the second container is one of cylindrical, spherical and snakelike tubular.

13. A rescue device of claim 2, wherein the second container is close to the intake of the first container which allows the outside dangerous chemicals to enter the first container, and the second container does not directly contact with the first container.

14. A rescue device of claim 3, wherein the second container is close to the intake of the first container which allows the outside dangerous chemicals to enter the first container, and the second container does not directly contact with the first container.

15. A rescue device of claim 4, wherein the second container is close to the intake of the first container which allows the outside dangerous chemicals to enter the first container, and the second container does not directly contact with the first container.

16. A rescue device of claim 2, wherein the opening is a manual vent valve.

17. A rescue device of claim 2, wherein the opening is an automatic vent valve.

18. A rescue device of claim 16, wherein the first container has a pressure sensor, where the pressure sensor detects that the change rate of the pressure in the first container is lower than a predetermined value, the automatic vent valve is controlled to open automatically.

19. A rescue device of claim 17, wherein the first container has a pressure sensor, where the pressure sensor detects that the change rate of the pressure in the first container is lower than a predetermined value, the automatic vent valve is controlled to open automatically.

20. A rescue method for treating leakage of dangerous chemicals comprising:

(1) providing a rescue device, which comprises:

a first container having a negative pressure chamber, the first container configured to be placed in an open position and a closed position, the open position allowing outside dangerous chemicals to enter the first container, the closed position preventing outside dangerous chemicals to enter the first container; and a second container installed and fixed in the first container, the second container contains a substantially harmless liquefied gas and has an opening which controllably communicates with the external environment;

(2) connecting the intake which allows the outside dangerous chemicals to enter the first container with a container, in which the dangerous chemicals are leaking, so as to introduce the dangerous chemicals which are not leaking into the rescue device; and (3) opening the opening of the second container and releasing the substantially harmless liquefied gas in the second container so that the temperature and pressure in the first container reduce so as to introduce more dangerous chemicals which are not leaking into the rescue device.

* * * * *